US005588876A

United States Patent [19]

Hayes et al.

[11] Patent Number: 5,588,876

[45] Date of Patent: Dec. 31, 1996

[54] FUSED ELECTRICAL CONNECTORS

[75] Inventors: Brian B. Hayes, Melbourne, Australia; Colin J. Hayes, London, England

[73] Assignee: Multico International Pty. Ltd., Melbourne, Australia

[21] Appl. No.: 437,189

[22] Filed: May 8, 1995

Related U.S. Application Data

[63] Continuation-in-part of Ser. No. 142,302, Nov. 23, 1993, Pat. No. 5,413,505.

[51] Int. Cl.[6] ..... H01R 13/68

[52] U.S. Cl. ..... 439/622; 439/680

[58] Field of Search ..... 439/621, 622, 439/831, 680

[56] References Cited

U.S. PATENT DOCUMENTS

| | | | |
|---|---|---|---|
| 2,558,581 | 6/1951 | Powell et al. | 439/621 |
| 4,274,698 | 6/1981 | Ahroni | 439/622 |
| 4,307,925 | 12/1981 | Drew | 439/622 |
| 4,488,767 | 12/1984 | Lehman et al. | 439/347 |
| 4,768,798 | 9/1988 | Wettengel et al. | 439/621 |
| 4,768,978 | 9/1988 | Weltengel et al. | 439/621 |
| 5,034,846 | 7/1991 | Houge et al. | 439/622 |
| 5,171,293 | 12/1992 | Umemoto et al. | 439/622 |
| 5,435,755 | 7/1995 | Chien et al. | 439/622 |

FOREIGN PATENT DOCUMENTS

| | | |
|---|---|---|
| 0016269 | 10/1980 | European Pat. Off. . |
| 511378 | 8/1939 | United Kingdom . |
| 580494 | 10/1946 | United Kingdom . |
| 1048110 | 11/1966 | United Kingdom . |
| 1453928 | 10/1976 | United Kingdom . |
| 2051499 | 1/1981 | United Kingdom . |
| 2098812 | 11/1982 | United Kingdom . |
| 2194395 | 3/1988 | United Kingdom . |

*Primary Examiner*—Gary F. Paumen
*Assistant Examiner*—T. C. Patel
*Attorney, Agent, or Firm*—Richard C. Litman

[57] ABSTRACT

A fused electrical connector having a molded body containing a fuse receptacle with a keyed construction. The keyed construction of the fuse receptacle is complementary to the fuse itself or a keyed construction attached to the fuse such that only a fuse having the correct key can be fitted to a particular connector. The keyed construction of the fuse receptacle may include channels and recesses which cooperate with formations on body parts which fit around a standard cartridge fuse. The keyed construction of the fuse receptacle may also include a central block which cooperate with a non-standard cartridge fuse.

5 Claims, 7 Drawing Sheets

FUSED ELECTRICAL CONNECTORS

CROSS-REFERENCE TO RELATED APPLICATION

This application is a continuation-in-part of application Ser. No. 08/142,302 U.S. Pat. No. 5,413,505 filed Nov. 23, 1993.

BACKGROUND OF THE INVENTION

1. Field of the Invention

This invention relates to fused electrical connectors and is particularly concerned with improvements in fused electrical plugs or sockets.

2. Description of the Prior Art

Electrical sockets or plugs provided with a replaceable fuse mounted in a carrier are generally known in the art as disclosed in British Patent Nos. 511,378 and 580,494. Great Britain Patent No. 1,048,110 discloses a fused electrical adaptor having a body molded of rigid plastics which is fitted with a cover, and a recess in the body to slidably receive a fuse carrier. Other three pin fused electrical plug assemblies suitable for use with domestic appliances are described in Great Britain Patent Nos. 2,051,499 and 2,098,812, and European Patent No. 16,269.

Ideally, electrical appliances should be fitted with a fuse having a rating which is matched to the current consumption of the appliance. Appliances which are connected to the main supply through a fly-lead include a plug assembly which is adapted to receive a cartridge fuse of an appropriate rating. Free plugs when supplied usually have fitted to them a fuse of the maximum allowable rating such as thirteen amp. It is common practice to provide appliances with a fly-lead including a molded-on plug and in this case the manufacturer can fit a fuse to the plug of a suitable rating for the current consumption of the appliance. Nevertheless, if the fuse has to be changed. It is quite likely that the wrong rating will be fitted.

SUMMARY OF THE INVENTION

Broadly and in accordance with the present invention, there is provided a fused electrical connector wherein the fuse or a carrier for the fuse has a keyed construction which is complementary to a keyed construction on the body of the connector whereby only a fuse or carrier having the correct key can be fitted to any particular connector.

In one embodiment of this invention, the connector incorporates a cavity with side walls having formations defining keyways which are complementary to formations provided on a carrier containing a fuse, the fuse carrier being engageable with the cavity and the cavity further including electrical contact means which are bridged by the fuse.

The fuse may itself have a body with the appropriate keyways or more preferably the fuse may comprise a cartridge type fuse which is located within a carrier provided on the outer surfaces with appropriate keyways to engage the cavity in the connector. With such an arrangement it is only possible for the correct rated fuse to be used with any particular connector and in an advantageous arrangement the carrier comprises parts which fit around a cartridge fuse so as to permanently engage the fuse preventing detachment. In a second aspect of this invention there is provided a fly-lead and electrical connector assembly for use with an electrical appliance, the connector being permanently molded onto the lead and in electrical connection with the conductors at an end of the lead and further incorporating a fuse assembly as hereinbefore referred to. With this arrangement coded leads complete with plugs, for example, can be supplied to a manufacturer or electrical fitter for fitting to an appliance with the lead and plug having the correct rated fuse which may only be replaced by a fuse of similar rating by virtue of the complementary engagement of the relevant keyways between the plug body and fuse carrier.

Such an arrangement firstly avoids the necessity for a consumer to fit his own plug to an appliance and secondly avoids the danger of a consumer inadvertently fitting the incorrect rated fuse as a replacement.

As will be understood, each different rating of fuse has a unique configuration of formations forming the keyways which only co-operate with the unique complementary formations provided on the connector body.

In yet a further embodiment of the present invention the body of the connector incorporates a cavity with a central block between the electrical contact means to accept only a non-standard cartridge fuse having uniquely configured end caps. The central block may have formations defining keyways which are complementary to formations provided on a body surrounding the fuse. This arrangement primarily prevents a standard cartridge fuse from making electrical contact and also provides the advantages of a keyed fuse assembly. In an aspect of this embodiment of the invention there is provided a fused electrical socket assembly to accept a standard jack for use on computers and like equipment.

This invention and further preferred features thereof are more fully described with reference to the following description and accompanying drawings which show a molded plug assembly for an appliance and a socket assembly for use on a computer with an integral fuse.

DETAILED DESCRIPTION OF THE PREFERRED EMBODIMENTS

Figure 1:
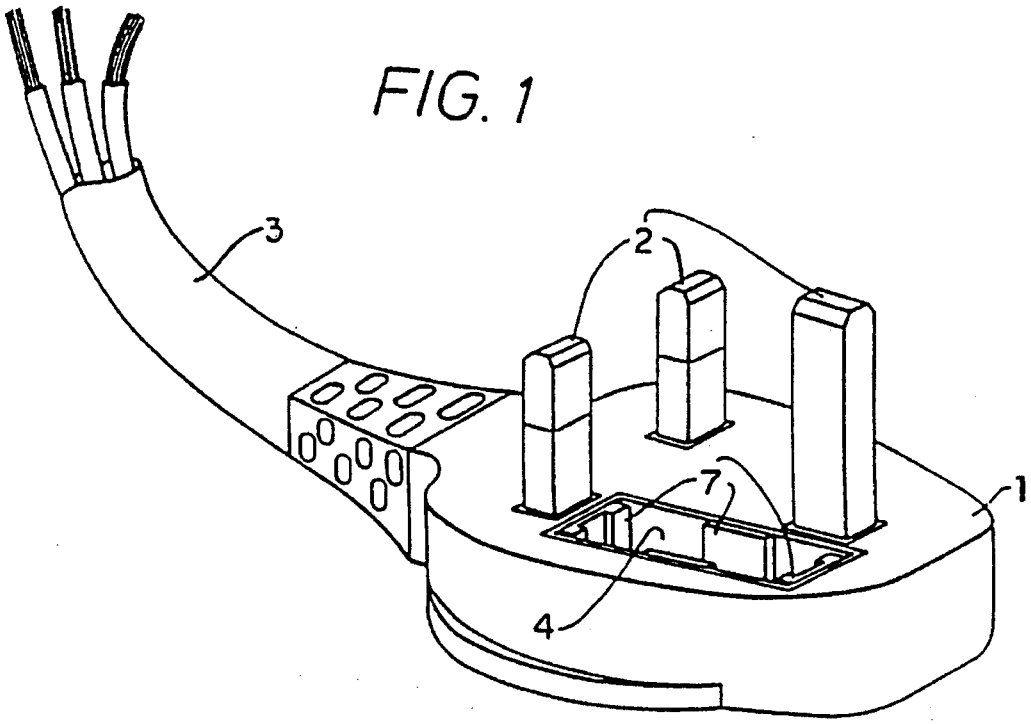
FIG. 1 shows a perspective view of a plug molded to the end of a fly-lead for connection with an appliance.

Referring to the drawings, FIG. 1 shows a British Standard three pin thirteen amp plug having a body 1 with electrical contact pins 2. The body 1 is integrally molded onto a fly-lead 3, which is for connection with an appliance.

Figure 2:
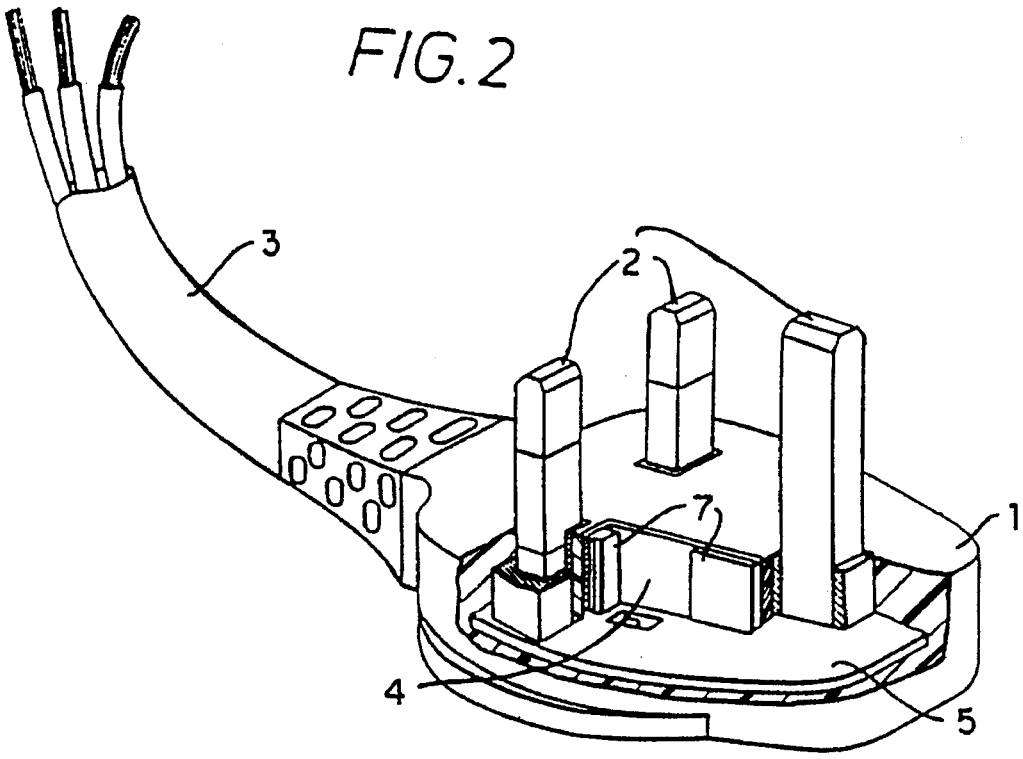
FIG. 2 shows a partially cutaway view of the plug of FIG. 1.

The electrical conductor within the lead 3 are connected with the appropriate pins internally before the plug body is molded onto the end of the lead. The body is provided with a cavity 4 formed by a plurality a sidewalls 4*a* and which is adapted to receive a fuse assembly. As shown in FIG. 2, the pins 2 and cavity 4 are carried on a base plate 5 to which the appropriate electrical connections are made with the base plate being thereafter integrally molded together with the body 1 by an injection molding process, for example.

Figure 3:
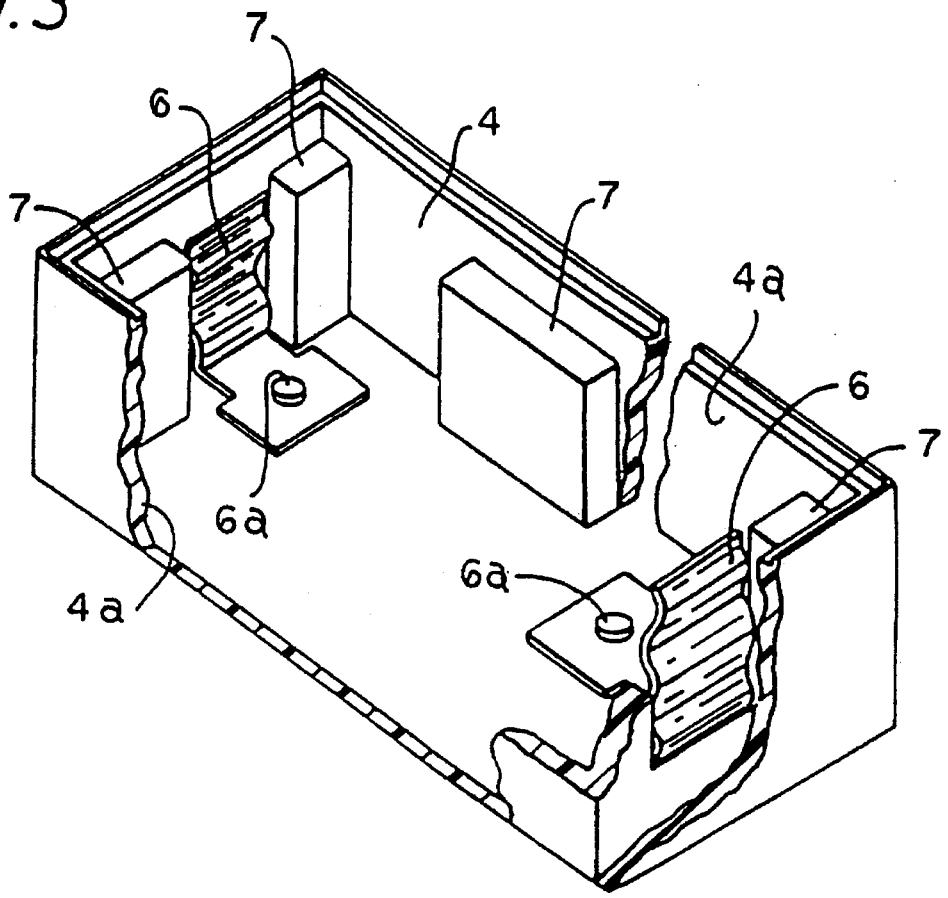
FIG. 3 shows a detail of the cavity for receiving the fuse.

As shown in FIG. 3, the plug body cavity 4 comprises a rectangular unit having connectors 6 at each end and with molded formations 7 forming keyways. The cavity 4 is adapted to receive a fuse carrier 8 which is shown in exploded view in FIG. 4 and includes sidewalls 8*a*. The carrier comprises two body parts 9 and 10 which define a cylindrical cavity 11 serving to receive a standard size cartridge fuse (not shown here). The two body parts 9 and 10 may be brought together and secured by means of inter-engaging spigots 12 and recesses 13 of which four are provided in the example shown. The spigots have suitable formations such that after engagement in the recesses 13 the parts cannot be easily separated and thus a cartridge fuse within the cavity 11 is secure against replacement. The top of the carrier may include slideways 14 which receive a latching tongue 15 having a lug 16 to engage a suitable recess in the body of the plug 1.

Figure 5:
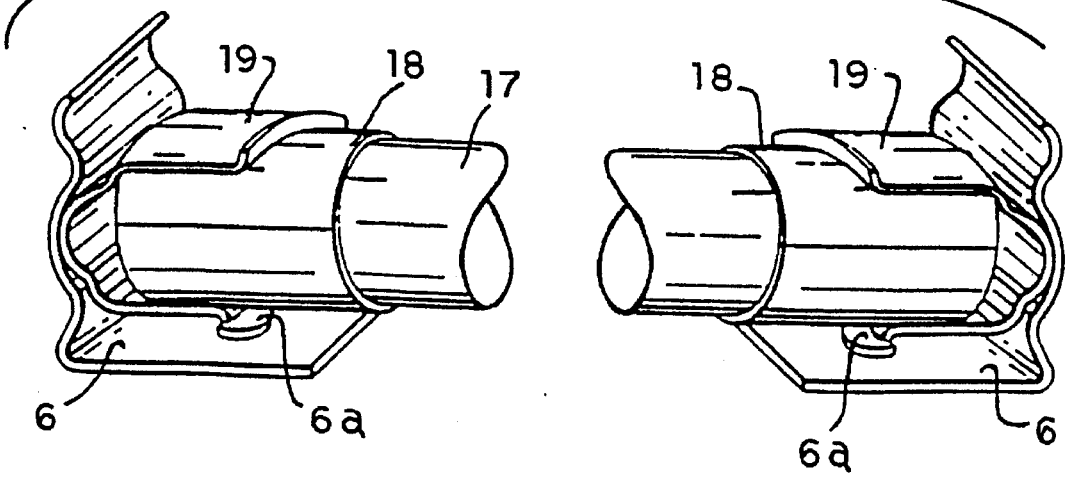
FIG. 5 shows the cartridge fuse carrier contacts.
Figure 6:
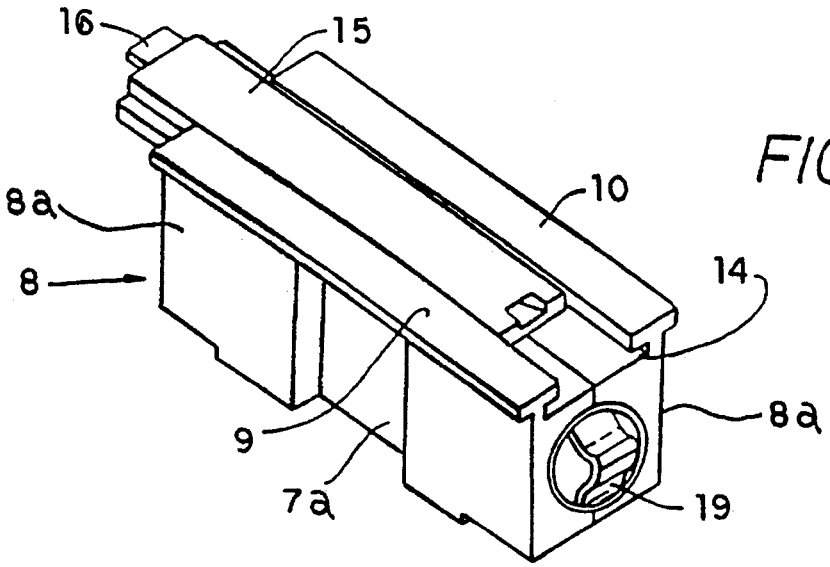
FIG. 6 shows the fuse carrier assembled.

The cartridge fuse and contact assembly is shown in FIG. 5 and this comprises a standard cylindrical cartridge fuse 17 having conductive end caps 18 which are received in conductive clips 19, this assembly fitting within the fuse carrier cavity 11 formed between the two carrier body parts 9 and 10 such that the conductive clips 19 protrude from each open end thereof as illustrated in FIG. 6. The clips 19 are designed to engage the clips 6 provided in the cavity 4 which clips are retained by suitable rivets 6*a*.

Figure 4:
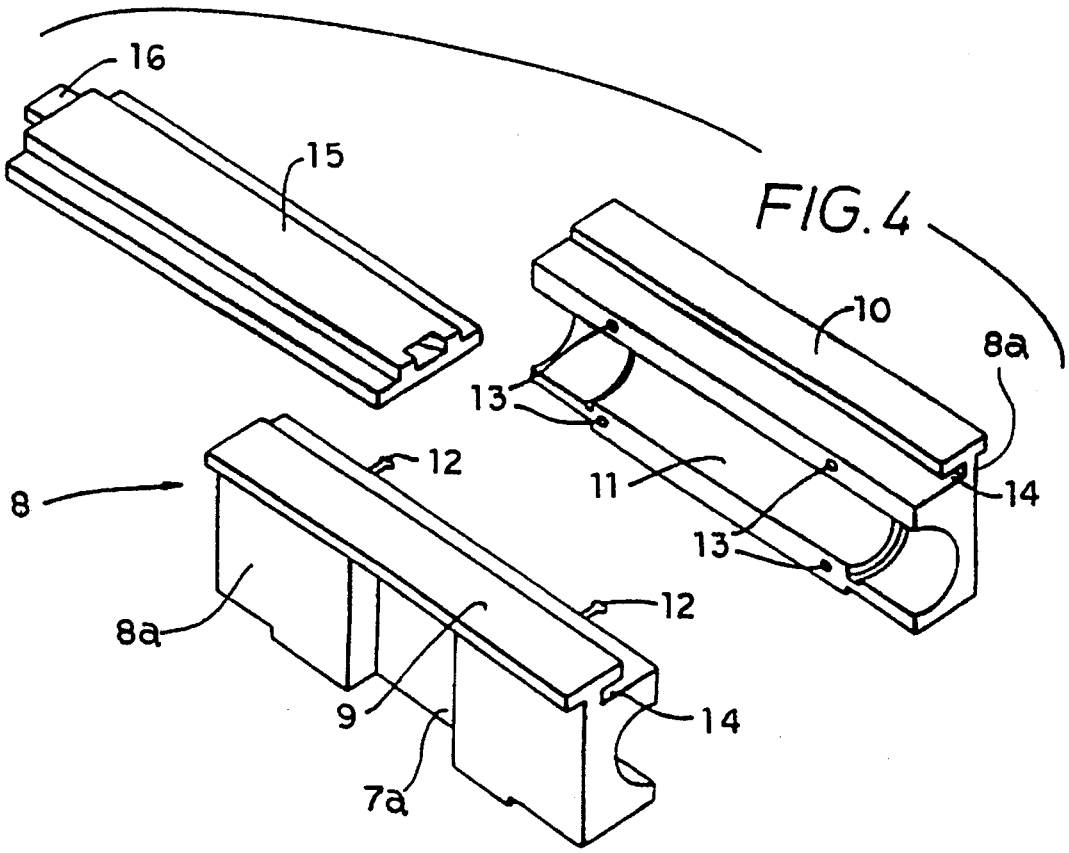
FIG. 4 shows an exploded view of the fuse carrier which engages the cavity of FIG. 3.

The fuse carrier as shown in FIGS. 4 and 6, includes formations 7*a* which are complementary to the formations 7 in the cavity 4 and thus only one unique fuse carrier will fit any particular cavity 4 provided within the plug body 1. The fuse carrier 8 is retained by means of the sliding tongue 15 which has the lug 16 which may be moved into the recess in the plug body to retain the assembly.

With a construction generally in accordance with this invention, the plug body 1 may be provided with one of a number of combinations of different keyways or formations, each of which can receive only one particular receptacle 8 containing the correct rated fuse for that appliance. A further feature of this invention is the arrangement of the connectors or contacts 6 within the cavity 4 which are configured to prevent a standard cartridge fuse being successfully inserted.

In a modified construction the sliding tongue 15 on the fuse carrier 8 may be omitted and the carrier held in the body cavity 4 by means of engaging detents or the like retaining means.

Where the connector is formed from a nylon or polyamide material and includes a flame retardant, the housing can be molded directly onto the pin carrying base of the plug. With such a hard material the keyways 7 can be molded directly into the connector body and have good wear resistance properties. An internal plate could be used to position the pins if required.

If a softer material such as PVC were to be used, then for safety reasons, the terminals would need to be covered with a heat resistant or flame retardant and this could be achieved by a plate member and a cover. The softer material would require the fuse carrier and the cavity in the connector body to be of a hard material to provide a good service life for the keyways 7.

Both the above constructions are within the scope of this invention.

Figure 7:
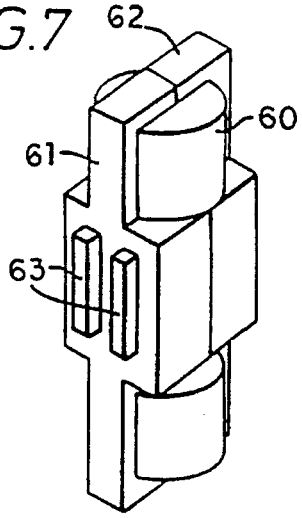
FIGS. 7 and 8 show a further keyed fuse.
Figure 8:
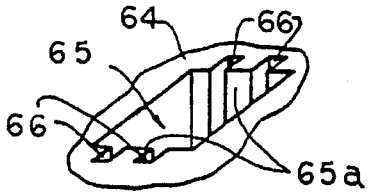
Figure 9:
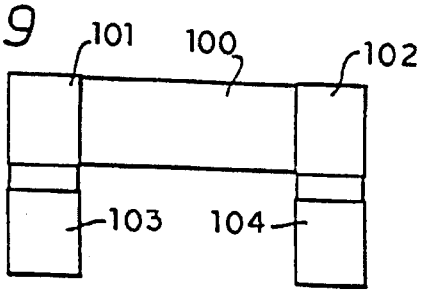
FIGS. 9 to 12 show yet a further key fuse arrangement.
Figure 10:
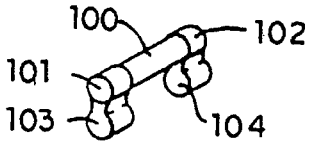

FIGS. 7 and 8 show a modification according to this invention, wherein the cartridge fuse 60 is clamped within a carrier or cage comprising two parts 61, 62 which snap engage together. The cage part 61 or 62 or both have spline formations 63 on an outer surface.

The plug body 64 has a cavity 65 extending from an outer surface and including on sidewalls 65*a*, channels 66 complementary to the spline 63 on the cage. The fuse and cage assembly may thus be pressed into the body of the plug with the spline forming the key such that only the correct fuse assembly may fit the chosen plug.

The aperture or cavity 65 in the plug body may be molded directly into the plug or may comprise a separate carrier which is inserted into the plug body after manufacture to adapt same to a particular fuse rating.

Figure 11:
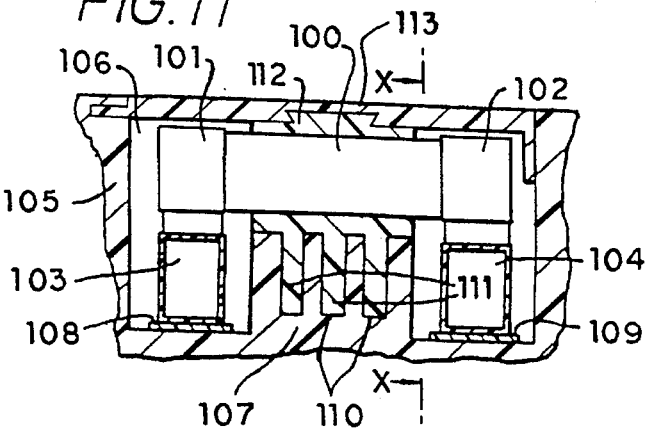
Figure 12:
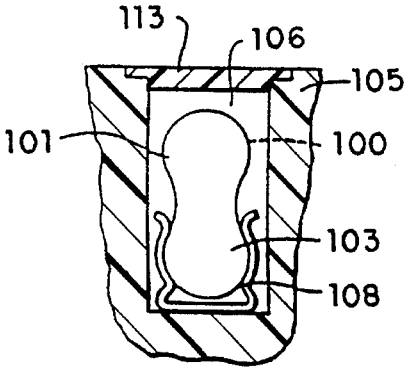

FIGS. 9, 10, 11 and 12 show yet a further arrangement primarily intended to prevent a standard cartridge fuse being fitted and having the advantageous feature of providing also a keyed fuse assembly. As shown a cartridge fuse 100, which may be a standard unit, is secured in end caps 101, 102 which include cylindrical connectors 103, 104. The body of the plug 105 has a recess 106 with a central block 107. Adjacent each side of block 107, spring clips 108, 109 are provided. A standard fuse cannot be pressed into electrical contact with both clips 108, 109 simultaneously; this may only be achieved through the caps 101, 102 and integral connectors 103, 104 as shown in FIG. 11 and 12.

A further feature of this construction is the provision of recesses 110 in block 107 which match fingers 111 on a cylindrical key 112 around fuse 100. The key 112 may engage with sliding closure 113 providing an integral assembly. Only the fuse having a correct key may be used in any given plug.

Figure 13:
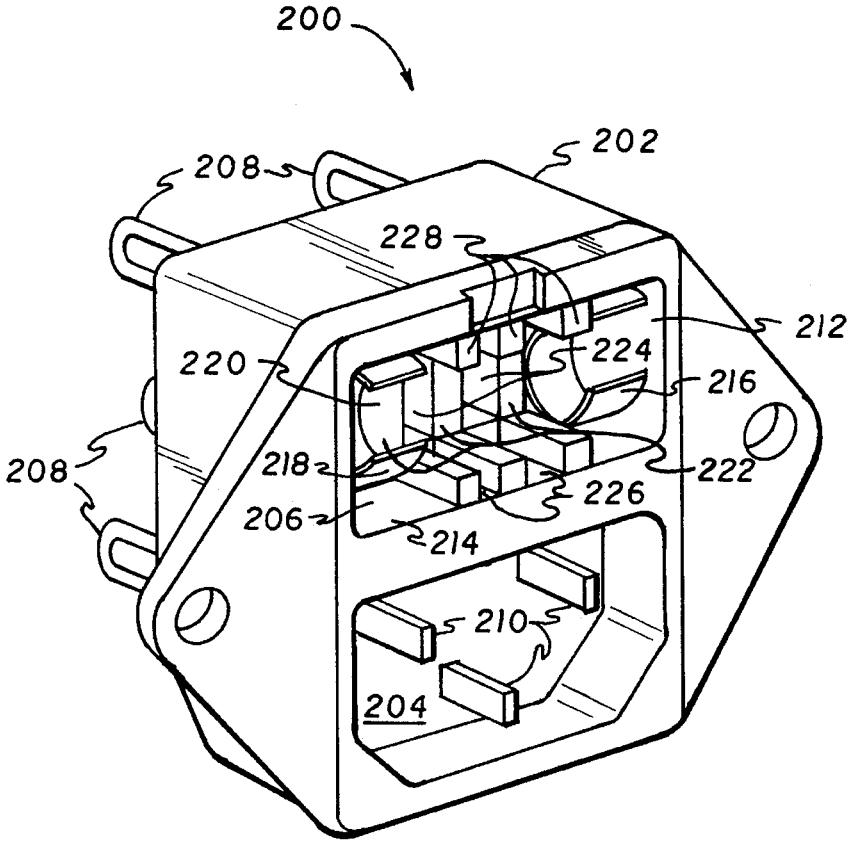
FIG. 13 shows a perspective view of a fused socket for use on a computer.

FIG. 13 shows a fused electrical socket 200 in accordance with the present invention which is adapted to receive a fuse or fuse assembly similar to the embodiments shown in FIGS. 9 through 12. Body 202 includes fuse receptacle 206 and a standard integrated electronic computer (I.E.C.) socket 204 which is for connection to a conventional computer or like equipment. Computer socket 204 accepts a standard three slot jack attached to a computer cable for connecting to a power source or peripheral devices. On the back of body 202 are terminals 208 for connection to electrical conductors within the computer and to the three electrical contact pins 210 in socket 204.

Fuse receptacle 206 has two ends 212 and 214. Electrical contacts in the form of spring clips 216 and 218 are positioned in the ends 212 and 214 of fuse receptacle 206. Central block 220 is molded as an integral part of body 202 between spring clips 216 and 218. Central block 220 prevents a standard fuse from simultaneously contacting both spring clips 216 and 218. In the base of central block 220 are molded recesses 224 surrounded by fingers 222. Recesses 226 and fingers 228 are also molded in the sides of central block 220. The fuse receptacle 206 is designed to accept fuse assembly 230.

Figure 14:
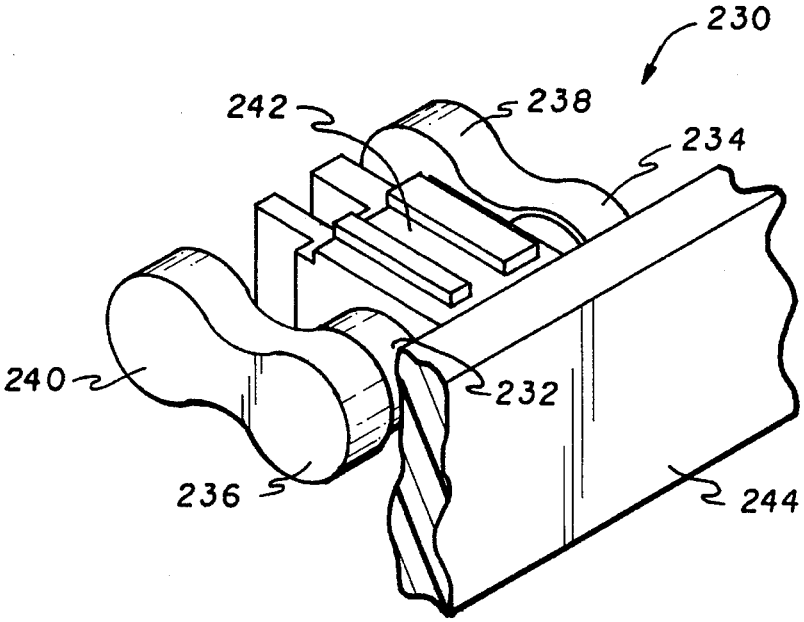
FIG. 14 shows a non-standard fuse in combination with a fuse carrier which engages the socket of FIG. 13.

Fuse assembly 230, shown in FIG. 14, includes fuse 232 and end caps 234 and 236. End caps 234 and 236 include connectors 238 and 240 which are designed to fit in spring clips 216 and 218. Surrounding fuse 232 is key 242, and attached to key 242 is closure plate 244.

Figure 16:
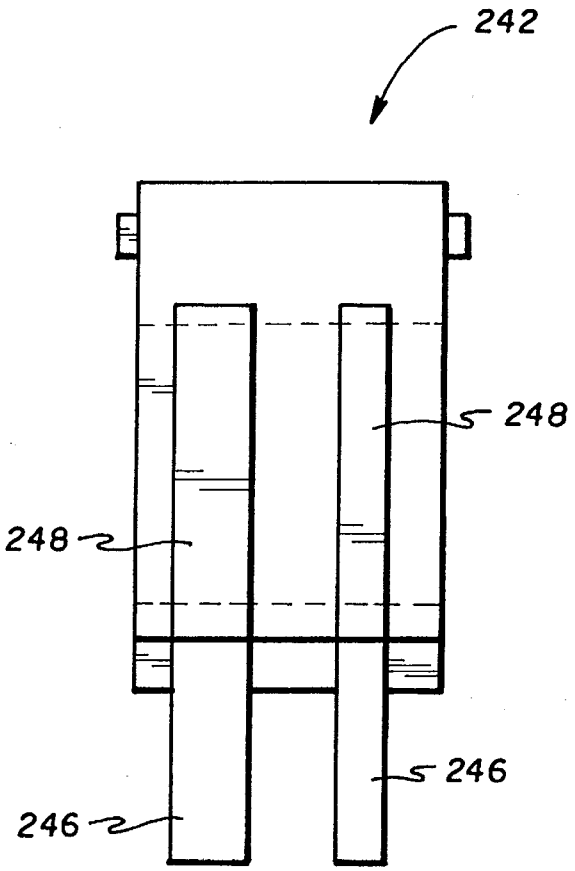
FIG. 16 shows a side view of the fuse carrier of FIG. 15.
Figure 15:
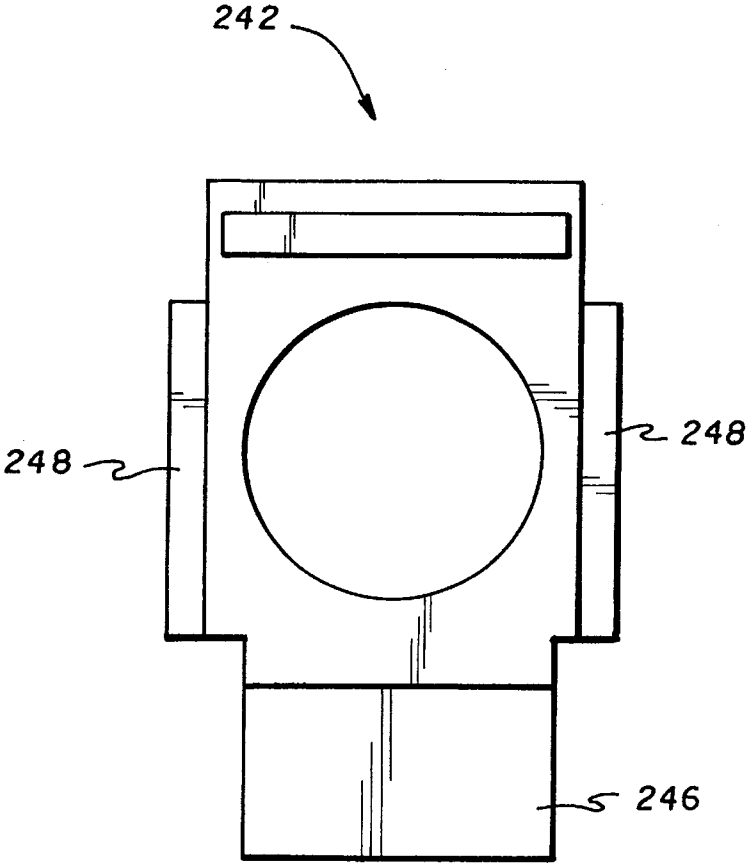
FIG. 15 shows an end view of the fuse carrier of FIG. 14 without the fuse.
Figure 17:
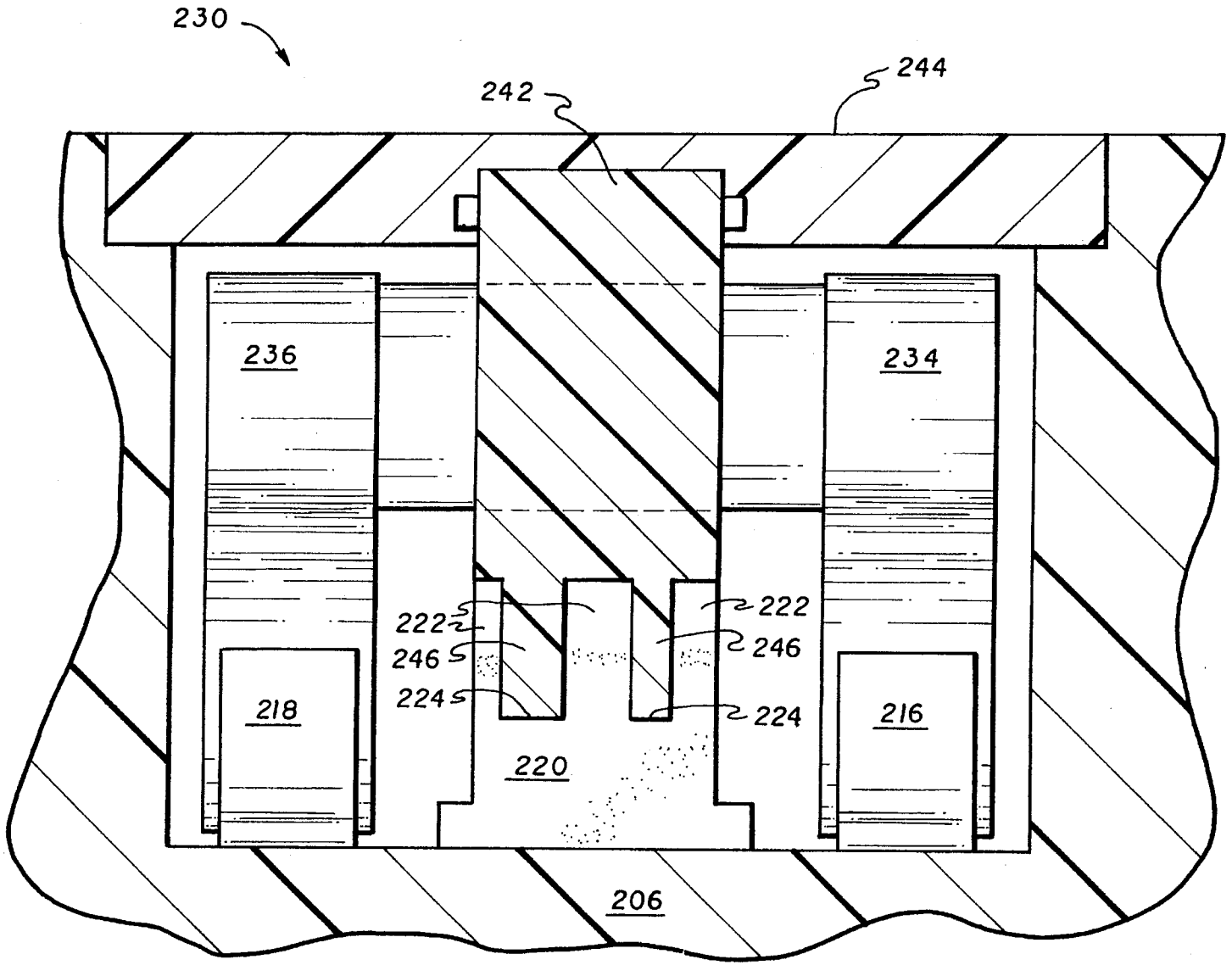
FIG. 17 shows a partial side view of the fuse carrier of FIG. 14 engaging the socket of FIG. 13.

Key 242 is shown in greater detail in FIGS. 15 and 16. Molded in the bottom of key 242 are fingers 246. On the sides of key 242 are molded fingers 248. As is shown in FIG. 17, fingers 246 are shaped to fit within recesses 224 when connectors 238 and 240 are in contact with spring clips 216 and 218 respectively. Also, fingers 248 fit within recesses 226. Only a fuse assembly with a key matching the central block of a fuse receptacle may be inserted in that particular fuse receptacle.

It is to be understood that the present invention is not limited to the exemplary embodiments described above. It will be apparent to those skilled in the art that various modifications and variations are possible within the spirit and scope of the present invention. The present invention encompasses any and all embodiments within the scope of the claims appended hereto.

We claim:

1. A fused electrical connector comprising:

a body having a fuse receptacle;

spaced apart electrical contacts within said fuse receptacle;

a central block affixed between said electrical contacts, said central block including linear keyways;

a cylindrical fuse for insertion into said fuse receptacle, said fuse having a longitudinal axis and including end caps, each said end cap including an integral elongate connector, each said connector extending substantially perpendicular to said longitudinal axis for engaging one of said electrical contacts upon insertion of said fuse into said fuse receptacle; and a central body secured to said fuse between said end caps, said central body including linear formations perpendicular to said longitudinal axis of said fuse to permit insertion of said fuse in a direction normal to the longitudinal axis of said fuse.

2. The fused connector of claim 1, wherein said body includes a standard computer socket for accepting a computer jack.

3. A fused computer socket comprising:

a molded body;

means for accepting a computer jack formed in said body;

a fuse receptacle having a central block including keyways formed in said body;

spaced apart electrical contacts disposed in said receptacle; and a fuse assembly having a longitudinal axis, said fuse assembly for insertion in said fuse receptacle, said fuse assembly including, a fuse, and a key attached to said fuse, said key including a plurality of linear key fingers perpendicular to the longitudinal axis of said fuse assembly, said key cooperating with said central block keyways to permit the insertion into said fuse receptacle of said fuse assembly in a direction normal to said longitudinal axis.

4. The fused computer socket according to claim 3 further including a closure plate attached to said key opposite said key fingers.

5. The fused computer socket according to claim 3, wherein said fuse is a non-standard cartridge fuse having end caps, each of said end caps having a connector for electrically connecting with each of said spaced apart electrical contacts.

* * * * *